US008723742B2

(12) United States Patent
Quintero Illera et al.

(10) Patent No.: US 8,723,742 B2
(45) Date of Patent: May 13, 2014

(54) MULTIBAND ANTENNA

(75) Inventors: Ramiro Quintero Illera, Barcelona (ES); Carles Puente Ballarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 58 days.

(21) Appl. No.: 13/532,869

(22) Filed: Jun. 26, 2012

(65) Prior Publication Data

US 2013/0162489 A1 Jun. 27, 2013

Related U.S. Application Data

(63) Continuation of application No. 12/910,016, filed on Oct. 22, 2010, now Pat. No. 8,228,245, which is a continuation of application No. 12/229,483, filed on Aug. 22, 2008, now Pat. No. 7,920,097, which is a continuation of application No. 11/702,791, filed on Feb. 6, 2007, now Pat. No. 7,439,923, which is a continuation of application No. 10/823,257, filed on Apr. 13, 2004, now Pat. No. 7,215,287, which is a continuation of application No. PCT/EP01/11912, filed on Oct. 16, 2001.

(51) Int. Cl.
*H01Q 1/24* (2006.01)

(52) U.S. Cl.
USPC ..... 343/702; 343/700 MS; 343/846

(58) Field of Classification Search
USPC ..... 343/700 MS, 702, 829, 846, 895
See application file for complete search history.

(56) References Cited

U.S. PATENT DOCUMENTS

| | | | | |
|---|---|---|---|---|
| 3,521,284 | A | 7/1970 | Shelton et al. | |
| 3,599,214 | A | 8/1971 | Altmayer | |
| 3,622,890 | A | 11/1971 | Fujimoto | |
| 3,683,376 | A | 8/1972 | Pronovost | |
| 3,818,490 | A | 6/1974 | Leahy | |
| 3,967,276 | A | 6/1976 | Goubau | |
| 3,969,730 | A | 7/1976 | Fuchser | |
| 4,024,542 | A | 5/1977 | Ikawa et al. | |
| 4,040,060 | A * | 8/1977 | Kaloi | 343/700 MS |
| 4,063,246 | A * | 12/1977 | Greiser | 343/700 MS |
| 4,131,893 | A | 12/1978 | Munson et al. | |
| 4,141,016 | A | 2/1979 | Nelson | |

(Continued)

FOREIGN PATENT DOCUMENTS

| | | |
|---|---|---|
| CA | 2416437 | 1/2002 |
| DE | 3337941 | 5/1985 |

(Continued)

OTHER PUBLICATIONS

Jaggard , D. L. Expert report of Dwight L. Jaggard (redacted)—expert witness retained by Fractus. Fractus. Feb. 23, 2011.

(Continued)

*Primary Examiner* — Tho G Phan
(74) *Attorney, Agent, or Firm* — Edell, Shapiro & Finnan, LLC

(57) ABSTRACT

A multiband antenna includes at least two polygons. The at least two polygons are spaced by means of a non-straight gap shaped as a space-filling curve, in such a way that the whole gap length is increased yet keeping its size and the same overall antenna size allowing for an effective tuning of frequency bands of the antenna.

20 Claims, 7 Drawing Sheets

(56) References Cited

U.S. PATENT DOCUMENTS

| | | | | |
|---|---|---|---|---|
| 4,471,358 | A | 9/1984 | Glasser | |
| 4,471,493 | A | 9/1984 | Schober | |
| 4,504,834 | A | 3/1985 | Garay et al. | |
| 4,543,581 | A | 9/1985 | Nemet | |
| 4,571,595 | A | 2/1986 | Phillips et al. | |
| 4,584,709 | A | 4/1986 | Kneisel et al. | |
| 4,590,614 | A | 5/1986 | Erat | |
| 4,623,894 | A | 11/1986 | Lee et al. | |
| 4,673,948 | A | 6/1987 | Kuo | |
| 4,730,195 | A | 3/1988 | Phillips et al. | |
| 4,839,660 | A | 6/1989 | Hadzoglou | |
| 4,843,468 | A | 6/1989 | Drewery | |
| 4,847,629 | A | 7/1989 | Shimazaki | |
| 4,849,766 | A | 7/1989 | Inaba et al. | |
| 4,857,939 | A | 8/1989 | Shimazaki | |
| 4,890,114 | A | 12/1989 | Egashira | |
| 4,894,663 | A | 1/1990 | Urbish et al. | |
| 4,907,011 | A | 3/1990 | Kuo | |
| 4,912,481 | A | 3/1990 | Mace et al. | |
| 4,975,711 | A | 12/1990 | Lee | |
| 5,030,963 | A | 7/1991 | Tadama | |
| 5,138,328 | A | 8/1992 | Zibrik et al. | |
| 5,168,472 | A | 12/1992 | Lockwood | |
| 5,172,084 | A | 12/1992 | Fiedziuszko et al. | |
| 5,200,756 | A | 4/1993 | Feller | |
| 5,214,434 | A | 5/1993 | Hsu | |
| 5,218,370 | A | 6/1993 | Blaese | |
| 5,227,804 | A | 7/1993 | Oda | |
| 5,227,808 | A | 7/1993 | Davis | |
| 5,245,350 | A | 9/1993 | Sroka | |
| 5,248,988 | A | 9/1993 | Makino | |
| 5,255,002 | A | 10/1993 | Day | |
| 5,257,032 | A | 10/1993 | Diamond et al. | |
| 5,347,291 | A | 9/1994 | Moore | |
| 5,355,144 | A | 10/1994 | Walton | |
| 5,355,318 | A | 10/1994 | Dionnet et al. | |
| 5,373,300 | A | 12/1994 | Jenness et al. | |
| 5,402,134 | A | 3/1995 | Miller et al. | |
| 5,420,599 | A | 5/1995 | Erkocevic | |
| 5,422,651 | A | 6/1995 | Chang | |
| 5,451,965 | A | 9/1995 | Matsumoto | |
| 5,451,968 | A | 9/1995 | Emery | |
| 5,453,751 | A | 9/1995 | Tsukamoto et al. | |
| 5,457,469 | A | 10/1995 | Diamond et al. | |
| 5,471,224 | A | 11/1995 | Barkeshli | |
| 5,493,702 | A | 2/1996 | Crowley et al. | |
| 5,495,261 | A | 2/1996 | Baker et al. | |
| 5,534,877 | A | 7/1996 | Sorbello et al. | |
| 5,537,367 | A | 7/1996 | Lockwood et al. | |
| 5,627,550 | A * | 5/1997 | Sanad | 343/700 MS |
| 5,684,672 | A | 11/1997 | Karidis et al. | |
| 5,712,640 | A | 1/1998 | Andou et al. | |
| 5,767,811 | A | 6/1998 | Mandai et al. | |
| 5,798,688 | A | 8/1998 | Schofield | |
| 5,821,907 | A | 10/1998 | Zhu et al. | |
| 5,841,403 | A | 11/1998 | West | |
| 5,867,126 | A | 2/1999 | Kawahata | |
| 5,870,066 | A | 2/1999 | Asakura et al. | |
| 5,872,546 | A | 2/1999 | Ihara et al. | |
| 5,898,404 | A | 4/1999 | Jou | |
| 5,903,240 | A | 5/1999 | Kawahata et al. | |
| 5,926,141 | A | 7/1999 | Lindenmeier et al. | |
| 5,943,020 | A | 8/1999 | Liebendoerfer et al. | |
| 5,966,097 | A | 10/1999 | Fukasawa et al. | |
| 5,966,098 | A | 10/1999 | Qi et al. | |
| 5,973,651 | A | 10/1999 | Suesada et al. | |
| 5,986,610 | A | 11/1999 | Miron | |
| 5,990,838 | A | 11/1999 | Burns et al. | |
| 6,002,367 | A | 12/1999 | Engblom et al. | |
| 6,002,369 | A * | 12/1999 | Richard | 343/700 MS |
| 6,028,568 | A | 2/2000 | Asakura et al. | |
| 6,031,499 | A | 2/2000 | Dichter | |
| 6,031,505 | A | 2/2000 | Qi et al. | |
| 6,040,803 | A * | 3/2000 | Spall | 343/700 MS |
| 6,078,294 | A | 6/2000 | Mitarai | |
| 6,091,365 | A | 7/2000 | Derneryd et al. | |
| 6,097,345 | A | 8/2000 | Walton | |
| 6,104,349 | A | 8/2000 | Cohen | |
| 6,127,977 | A | 10/2000 | Cohen | |
| 6,131,042 | A | 10/2000 | Lee et al. | |
| 6,133,879 | A | 10/2000 | Grangeat | |
| 6,140,969 | A | 10/2000 | Lindenmeier et al. | |
| 6,140,975 | A | 10/2000 | Cohen | |
| 6,160,513 | A | 12/2000 | Davidson et al. | |
| 6,172,618 | B1 | 1/2001 | Hakozaki et al. | |
| 6,211,824 | B1 | 4/2001 | Holden et al. | |
| 6,218,992 | B1 | 4/2001 | Sadler et al. | |
| 6,236,372 | B1 | 5/2001 | Lindenmeier et al. | |
| 6,252,554 | B1 | 6/2001 | Isohatala | |
| 6,266,023 | B1 | 7/2001 | Nagy et al. | |
| 6,281,846 | B1 | 8/2001 | Puente Baliarda et al. | |
| 6,297,776 | B1 * | 10/2001 | Pankinaho | 343/700 MS |
| 6,307,511 | B1 | 10/2001 | Ying et al. | |
| 6,329,951 | B1 | 12/2001 | Wen et al. | |
| 6,329,954 | B1 | 12/2001 | Fuchs et al. | |
| 6,343,208 | B1 | 1/2002 | Ying | |
| 6,366,243 | B1 | 4/2002 | Isohatala et al. | |
| 6,367,939 | B1 | 4/2002 | Carter et al. | |
| 6,407,710 | B2 | 6/2002 | Keilen et al. | |
| 6,417,810 | B1 | 7/2002 | Huels et al. | |
| 6,431,712 | B1 | 8/2002 | Turnbull | |
| 6,445,352 | B1 | 9/2002 | Cohen | |
| 6,452,549 | B1 | 9/2002 | Lo | |
| 6,452,551 | B1 | 9/2002 | Chen | |
| 6,452,553 | B1 | 9/2002 | Cohen | |
| 6,466,170 | B2 * | 10/2002 | Zhou | 343/700 MS |
| 6,466,176 | B1 | 10/2002 | Maoz et al. | |
| 6,476,766 | B1 | 11/2002 | Cohen | |
| 6,476,767 | B2 | 11/2002 | Aoyama et al. | |
| 6,496,148 | B2 | 12/2002 | Ngounou Kouam et al. | |
| 6,525,691 | B2 | 2/2003 | Varadan et al. | |
| 6,545,640 | B1 | 4/2003 | Herve et al. | |
| 6,552,690 | B2 | 4/2003 | Veerasamy | |
| 6,606,062 | B2 | 8/2003 | Ngounou Kouam et al. | |
| 6,642,898 | B2 | 11/2003 | Eason | |
| 6,664,932 | B2 | 12/2003 | Sabet et al. | |
| 2002/0000940 | A1 | 1/2002 | Moren et al. | |
| 2002/0000942 | A1 | 1/2002 | Duroux | |
| 2002/0003499 | A1 | 1/2002 | Kouam et al. | |
| 2002/0036594 | A1 | 3/2002 | Gyenes | |
| 2002/0105468 | A1 | 8/2002 | Tessier et al. | |
| 2002/0109633 | A1 | 8/2002 | Ow | |
| 2002/0126054 | A1 | 9/2002 | Fuerst et al. | |
| 2002/0126055 | A1 | 9/2002 | Lindenmeier et al. | |
| 2002/0175866 | A1 | 11/2002 | Gram | |
| 2002/0175879 | A1 | 11/2002 | Sabet et al. | |
| 2002/0196191 | A1 | 12/2002 | Ngounou Kouam et al. | |
| 2004/0217916 | A1 | 11/2004 | Quintero Illera et al. | |

FOREIGN PATENT DOCUMENTS

| | | |
|---|---|---|
| EP | 0096847 | 12/1983 |
| EP | 0297813 | 1/1989 |
| EP | 0358090 | 3/1990 |
| EP | 0543645 | 5/1993 |
| EP | 0571124 | 11/1993 |
| EP | 0688040 | 12/1995 |
| EP | 0765001 | 9/1996 |
| EP | 0814536 | 12/1997 |
| EP | 0871238 | 10/1998 |
| EP | 0892459 | 1/1999 |
| EP | 0929121 | 7/1999 |
| EP | 0932219 | 7/1999 |
| EP | 0942488 | 9/1999 |
| EP | 0969375 | 1/2000 |
| EP | 0986130 | 3/2000 |
| EP | 0997974 | 5/2000 |
| EP | 1018777 | 7/2000 |
| EP | 1018779 | 7/2000 |
| EP | 1071161 | 1/2001 |
| EP | 1079462 | 2/2001 |
| EP | 1083624 | 3/2001 |
| EP | 1094545 | 4/2001 |
| EP | 1096602 | 5/2001 |

(56) References Cited

FOREIGN PATENT DOCUMENTS

| | | |
|---|---|---|
| EP | 1128466 | 8/2001 |
| EP | 1148581 | 10/2001 |
| EP | 1198027 | 10/2001 |
| EP | 1237224 | 9/2002 |
| EP | 1267438 | 12/2002 |
| ES | 2112163 | 3/1998 |
| ES | 2142280 | 5/2000 |
| FR | 2543744 | 10/1984 |
| FR | 2704359 | 11/1994 |
| GB | 2215136 | 9/1989 |
| GB | 2330951 | 5/1999 |
| GB | 2355116 | 4/2001 |
| JP | 55147806 | 11/1980 |
| JP | 5129816 | 10/1991 |
| JP | 05007109 | 1/1993 |
| JP | 5267916 | 10/1993 |
| JP | 05347507 | 12/1993 |
| JP | 6204908 | 7/1994 |
| JP | 10-209744 | 8/1998 |
| WO | 95/11530 | 4/1995 |
| WO | 96/27219 | 9/1996 |
| WO | 96/29755 | 9/1996 |
| WO | 96/38881 | 12/1996 |
| WO | 97/06578 | 2/1997 |
| WO | 97/11507 | 3/1997 |
| WO | 97/32355 | 9/1997 |
| WO | 97/33338 | 11/1997 |
| WO | 97/35360 | 11/1997 |
| WO | 97/47054 | 12/1997 |
| WO | 98/12771 | 3/1998 |
| WO | 98/36469 | 8/1998 |
| WO | 99/03166 | 1/1999 |
| WO | 99/03167 | 1/1999 |
| WO | 99/25042 | 5/1999 |
| WO | 99/27608 | 6/1999 |
| WO | 99/56345 | 11/1999 |
| WO | 00/01028 | 1/2000 |
| WO | 00/03453 | 1/2000 |
| WO | 00/22695 | 4/2000 |
| WO | 00/36700 | 6/2000 |
| WO | 00/49680 | 8/2000 |
| WO | 00/52767 | 9/2000 |
| WO | 00/52784 | 9/2000 |
| WO | 00/52787 | 9/2000 |
| WO | 01/03238 | 1/2001 |
| WO | 01/08257 | 2/2001 |
| WO | 01/13464 | 2/2001 |
| WO | 01/17064 | 3/2001 |
| WO | 01/22528 | 3/2001 |
| WO | 01/24314 | 4/2001 |
| WO | 01/26185 | 4/2001 |
| WO | 01/28035 | 4/2001 |
| WO | 01/31739 | 5/2001 |
| WO | 01/33665 | 5/2001 |
| WO | 01/35491 | 5/2001 |
| WO | 01/37369 | 5/2001 |
| WO | 01/37370 | 5/2001 |
| WO | 01/41252 | 6/2001 |
| WO | 01/48861 | 7/2001 |
| WO | 01/54225 | 7/2001 |
| WO | 01/73890 | 10/2001 |
| WO | 01/78192 | 10/2001 |
| WO | 01/82410 | 11/2001 |
| WO | 02/35646 | 5/2002 |
| WO | 02/091518 | 11/2002 |
| WO | 02/095874 | 11/2002 |
| WO | 02/096166 | 11/2002 |
| WO | 03/023900 | 3/2003 |

OTHER PUBLICATIONS

Jaggard , D. L. Rebuttal expert report of Dr. Dwight L. Jaggard (redacted version). Fractus. Feb. 16, 2011.

Long , S. Rebuttal expert report of Dr. Stuart A. Long (redacted version). Fractus. Feb. 16, 2011.

Ali , M. ; Hayes , G. J. et al. A triple band internal antenna for mobile handheld terminals. Antennas and Propagation Society International Symposium, 2002. IEEE. Jun. 16, 2002.

Anguera , J. ; Puente , C. ; Borja , C. ; Romeu , J. Miniature wideband stacked microstrip patch antenna based on the sierpinski fractal geometry. Antennas and Propagation Society International Symposium, 2000. IEEE. vol. 3. pp. 1700-1703. Jul. 1, 2000.

Borja , C. High directivity fractal boundary microstrip patch antenna. Electronic Letters. vol. 36. N. 9. Apr. 27, 2000.

Chen , H. et al. Bandwidth enhancement of a microstrip antenna with embedded reactive loading. Microwave and Optical Technology Letters. Jul. 20, 2000.

Chen , H. et al. Dual-frequency rectangular microstrip antenna with double pi-shaped slots. Microwave and Optical Technology Letters. May 5, 2001.

Chen , Wen-S. Small circularly polarized microstrip antennas. Antennas and Propagation Society International Symposium, 1999. IEEE. Jul. 11, 1999.

Cohen, N. Fractal antenna applications in wireless telecommunications. IEEE Electronic Industries Forum of New England. Professional Program Proceedings Boston. pp. 43-49. May 6, 1997.

Gough , C. E. ; Porch , A. ; Lancaster , M. J. et al. High Tc coplanar resonators for microwave applications and scientific studies. Physica. vol. 282-287. N. 2001. pp. 395-398. Aug. 1, 1997.

Hansen , R. C. Fundamental limitations in antennas. IEEE Proceedings. vol. 69. N. 2. pp. 170-182. Feb. 1, 1981.

Hara Prasad , R. V. Microstrip fractal patch antenna for multiband communication. IEEE Electromagnetic Letters. vol. 36, N. 14, pp. 1179-1180. Jul. 6, 2000.

Hohlfeld , R. G. ; Cohen N. Self-similarity and the geometric requirements for frequency independence in antennae. Fractals. vol. 7, N. 1, pp. 79-84. Jan. 17, 1999.

Jaggard , D. L. Fractal electrodynamics and modeling. Directions in electromagnetic wave modeling. pp. 435-446. Jan. 1, 1991.

Kim , H. H. et al. Surface-mounted chip dielectric ceramic antenna for PCS phone. 5th International Symposium on Antennas, Propagation and EM Theory, 2000. Proceedings, ISAPE 2000, Aug. 15, 2000.

Lu , Jui H. Single-feed dual-frequency triangular microstrip antenna with a pair of bent slots. Microwave and Optical Technology Letters. Mar. 20, 2001.

Meinke , H. ; Gundlah , F. V. Radio engineering reference book—vol. 1—Radio components. Circuits with lumped parameters . . . State energy publishing house. 4 p.. Jan. 1, 1961.

Morishita , H. et al. Design concept of antennas for small mobile terminals and the future perspective. Antennas and Propagation Magazine, IEEE. Oct. 1, 2002.

Mumbru , J. ; Quintero , R. ; Puente , C. Analysis and improvements of the J. Ollikainen, O. Kivekäs, A. Toropainen, P. Vainikainen, "Internal Dual-Band Patch Antenna for Mobile Phones", APS-2000 Millennium Conference on Antennas and Propagation, Davos, Switzerland, Apr. 2000. Fractus. Jul. 4, 2001.

Ollikainen , J. et al. Internal dual-band patch antenna for mobile phones. Antennas and Propagation, IEEE Transactions on. Apr. 9, 2000.

Parker , E. A. ; A. N. A. El Sheikh Convoluted array elements and reduced size unit cells for frequency selective surfaces. IEE Proceedings H. pp. 19-22. Feb. 1, 1991.

Pribetich , P. ; Combet , Y. et al. Quasifractal planar microstrip resonators for microwave circuits. Microwave and Optical Technology Letters. vol. 21. N. 6. pp. 433-436. Jun. 20, 1999.

Puente , C. ; Claret , J. ; Sagues , F. et al. Multiband properties of a fractal tree antenna generated by electrochemical deposition. Electronic Letters. vol. 32. N. 25. pp. 2298-2299. Dec. 5, 1996.

Puente , C. ; Romeu , J. ; Cardama, A. The Koch monopole—a small fractal antenna. Antennas and Propagation, IEEE Transactions on. vol. 48. N. 11. Nov. 1, 2000.

Puente , C. et al. Small but long Koch fractal monopole. Electronic Letters. vol. 34. N. 1. pp. 9-10. Jan. 8, 1998.

Romeu , J. ; Blanch , S. A three dimensional hilbert antenna. Antennas and Propagation Society International Symposium, 2002. IEEE. Jun. 16, 2002.

(56) References Cited

OTHER PUBLICATIONS

Samavati , Hirad ; Hajimiri , Ali et al. Fractal capacitors. IEEE Journal of solid state circuits. vol. 33. N. 12. pp. 2035-2041. Dec. 1, 1998.
Sanad , Mohamed a compact dual broadband microstrip antenna having both stacked and planar parasitic elements. Antennas and Propagation Society International Symposium, 1996. AP-S. Digest. pp. 6-9. Jul. 21, 1996.
Volgov , V. A. Parts and units of radio electronic equipment. Energiya. Jan. 1, 1967.
Wong , K. L. ; Sze , J. Y. Dual-frequency slotted rectangular microstrip antenna. Electronic Letters. Jul. 9, 1998.
Zhang , Dawei ; Liang , G.C. ; Shih , C.F. Narrowband lumped element microstrip filters using capacitively loaded inductors. Microwave Symposium Digest, 1995., IEEE MTT-S International. pp. 379-382. May 16, 1995.
U.S. Appl. No. 10/823,257—Response to Office Action dated on Jul. 10, 2006. Jenkens & Gildcrhist. Oct. 13, 2006.
U.S. Appl. No. 10/823,257—Office Action dated on Jul. 10, 2006. USTPO. Jul. 10, 2006.
U.S. Appl. No. 10/823,257—Response to Office Action dated on Jun. 29, 2005. Jenkens & Gilchrist. Dec. 1, 2005.
U.S. Appl. No. 10/823,257—Office Action dated on Jun. 29, 2005. USPTO. Jun. 29, 2005.
U.S. Appl. No. 10/823,257—Notice of allowance dated on May 12, 2006. USPTO. May 12, 2006.
U.S. Appl. No. 10/823,257—Office Action dated on Feb. 23, 2006. USPTO. Feb. 23, 2006.
U.S. Appl. No. 10/823,257—Response to Office Action dated Feb. 23, 2006. Jenkens & Gildchrist. May 2, 2006.
U.S. Appl. No. 11/702,791—Notice of Allowance dated on Sep. 14, 2008. USPTO. Sep. 14, 2008.
U.S. Appl. No. 11/702,791—Office Action dated on Feb. 19, 2008, USPTO. Feb. 19, 2008.
U.S. Appl. No. 11/702,791—Response to Office Action dated on Feb. 19, 2008. Winstead. Jun. 12, 2008.
U.S. Appl. No. 12/229,483—Notice of allowance dated on Sep. 21, 2010. USPTO. Sep. 21, 2010.
U.S. Appl. No. 12/229,483—Office Action dated on Mar. 9, 2010. USPTO. Mar. 9, 2010.
U.S. Appl. No. 12/229,483—Response to Office Action dated on Mar. 9, 2010. Winstead. Sep. 3, 2010.
U.S. Appl. No. 12/910,016—Office action dated on Sep. 15, 2011.
U.S. Appl. No. 12/910,016—Response to the office action Sep. 15, 2012 dated on Feb. 14, 2012.
U.S. Appl. No. 12/910,016—Notice of allowance dated on Mar. 30, 2012.

* cited by examiner

MULTIBAND ANTENNA

CROSS-REFERENCE TO RELATED APPLICATIONS

This patent application is a continuation of U.S. patent application Ser. No. 12/910,016, filed on Oct. 22, 2010 now U.S. Pat. No. 8,228,245. U.S. patent application Ser. No. 12/910,016 is a continuation of U.S. patent application Ser. No. 12/229,483, filed on Aug. 22, 2008 which is now U.S. Pat. No. 7,920,097. U.S. patent application Ser. No. 12/229,483 is a continuation of U.S. patent Ser. No. 11/702,791, filed on Feb. 6, 2007 which is now U.S. Pat. No. 7,439,923. U.S. patent application Ser. No. 11/702,791 is a continuation of U.S. patent application Ser. No. 10/823,257, filed on Apr. 13, 2004 which is now U.S. Pat. No. 7,215,287. U.S. patent application Ser. No. 10/823,257 is a continuation of PCT/EP01/011912, filed on Oct. 16, 2001. U.S. patent application Ser. No. 12/910,016, U.S. Pat. No. 7,920,097, U.S. Pat. No. 7,439,923, U.S. Pat. No. 7,215,287, and International Application No. PCT/EP01/011912 are incorporated herein by reference.

OBJECT AND BACKGROUND OF THE INVENTION

The present invention relates generally to a new family of antennas with a multiband behaviour. The general configuration of the antenna consists of a multilevel structure which provides the multiband behaviour. A description on Multilevel Antennas can be found in Patent Publication No. WO01/22528. In the present invention, a modification of said multilevel structure is introduced such that the frequency bands of the antenna can be tuned simultaneously to the main existing wireless services. In particular, the modification consists of shaping at least one of the gaps between some of the polygons in the form of a non-straight curve.

Several configurations for the shape of said non: straight curve are allowed within the scope of the present invention. Meander lines, random curves or space-filling curves, to name some particular cases, provide effective means for conforming the antenna behaviour. A thorough description of Space-Filling curves and antennas is disclosed in patent "Space-Filling Miniature Antennas" (Patent Publication No. WO01/54225).

Although patent publications WO01/22528 and WO01/54225 disclose some general configurations for multiband and miniature antennas, an improvement in terms of size, bandwidth and efficiency is obtained in some applications when said multilevel antennas are set according to the present invention. Such an improvement is achieved mainly due to the combination of the multilevel structure in conjunction of the shaping of the gap between at least a couple of polygons on the multilevel structure. In some embodiments, the antenna is loaded with some capacitive elements to finely tune the antenna frequency response.

In some particular embodiments of the present invention, the antenna is tuned to operate simultaneously at five bands, those bands being for instance GSM900 (or AMPS), GSM1800, PCS1900, UMTS, and the 2.4 GHz band for services such as for instance Bluetooth™. IEEE802.11b and HiperLAN. There is in the prior art one example of a multilevel antenna which covers four of said services, see embodiment (3) in FIG. 1, but there is not an example of a design which is able to integrate all five bands corresponding to those services aforementioned into a single antenna.

The combination of said services into a single antenna device provides an advantage in terms of flexibility and functionality of current and future wireless devices. The resulting antenna covers the major current and future wireless services, opening this way a wide range of possibilities in the design of universal, multi-purpose, wireless terminals and devices that can transparently switch or simultaneously operate within all said services.

SUMMARY OF THE INVENTION

The key point of the present invention consists of combining a multilevel structure for a multiband antenna together with an especial design on the shape of the gap or spacing between two polygons of said multilevel structure. A multilevel structure for an antenna device consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting multilevel structure. In this definition of multilevel structures, circles and ellipses are included as well, since they can be understood as polygons with a very large (ideally infinite) number of sides.

Some particular examples of prior-art multilevel structures for antennas are found in FIG. 1. A thorough description on the shapes and features of multilevel antennas is disclosed in patent publication WO01/22528. For the particular case of multilevel structure described in drawing (3), FIG. 1 and in FIG. 2, an analysis and description on the antenna behaviour is found in (J. Ollikainen, O Kivekäs, A. Toropainen, P. Vainikainen, "Internal Dual-Band Patch Antenna for Mobile Phones", APS-2000 Millennium Conference on Antennas and Propagation, Davos, Switzerland, April 2000).

When the multiband behaviour of a multilevel structure is to be packed in a small antenna device, the spacing between the polygons of said multilevel structure is minimized. Drawings (3) and (4) in FIG. 1 are some examples of multilevel structures where the spacing between conducting polygons (rectangles and squares in these particular cases) take the form of straight, narrow gaps.

In the present invention, at least one of said gaps is shaped in such a way that the whole gap length is increased yet keeping its size and the same overall antenna size. Such a configuration allows an effective tuning of the frequency bands of the antenna, such that with the same overall antenna size, said antenna can be effectively tuned simultaneously to some specific services, such as for instance the five frequency bands that cover the services AMPS, GSM900, GSM1800, PCS1900, UMTS, Bluetooth™, IEEE802.11b or HiperLAN.

FIGS. 3 to 7 show some examples of how the gap of the antenna can be effectively shaped according to the present invention. For instance, gaps (109), (110), (112), (113), (114), (116), (118), (120), (130), (131), and (132) are examples of non-straight gaps that take the form of a curved or branched line. All of them have in common that the resonant length of the multilevel structure is changed, changing this way the frequency behaviour of the antenna. Multiple configurations can be chosen for shaping the gap according to the present invention:

a) A meandering curve.

b) A periodic curve.

c) A branching curve, with a main longer curve with one or more added segments or branching curves departing from a point of said main longer curve.

d) An arbitrary curve with 2 to 9 segments.

e) An space-filling curve.

An Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the gap according to the present invention, the segments of the SFC curves included in said multilevel structure must be shorter than a tenth of the free-space operating wavelength.

It is interesting noticing that, even though ideal fractal curves are mathematical abstractions and cannot be physically implemented into a real device, some particular cases of SFC can be used to approach fractal shapes and curves, and therefore can be used as well according to the scope and spirit of the present invention.

The advantages of the antenna design disclosed in the present invention are:

(a) The antenna size is reduced with respect to other prior-art multilevel antennas.

(b) The frequency response of the antenna can be tuned to five frequency bands that cover the main current and future wireless services (among AMPS, GSM900, GSM1800, PCS1900, Bluetooth™, IEEE802.11b and HiperLAN).

Those skilled in the art will notice that current invention can be applied or combined to many existing prior-art antenna techniques. The new geometry can be, for instance, applied to microstrip patch antennas, to Planar Inverted-F antennas (PIFAs), to monopole antennas and so on. FIGS. 6 and 7 describe some patch of PIFA like configurations. It is also clear that the same antenna geometry can be combined with several ground-planes and radomes to find applications in different environments: handsets, cellular phones and general hand-held devices; portable computers (Palmtops, PDA, Laptops, . . . ), indoor antennas (WLAN, cellular indoor coverage), outdoor antennas for microcells in cellular environments, antennas for cars integrated in rear-view mirrors, stop-lights, bumpers and so on.

In particular, the present invention can be combined with the new generation of ground-planes described in the PCT application entitled "Multilevel and Space-Filling Ground-planes for Miniature and Multiband Antennas", which describes a ground-plane for an antenna device, comprising at least two conducting surfaces, said conducting surfaces being connected by at least a conducting strip, said strip being narrower than the width of any of said two conducting surfaces.

When combined to said ground-planes, the combined advantages of both inventions are obtained: a compact-size antenna device with an enhanced bandwidth, frequency behaviour, VSWR, and efficiency.

DETAILED DESCRIPTION OF THE PREFERRED EMBODIMENTS

Figure 1:
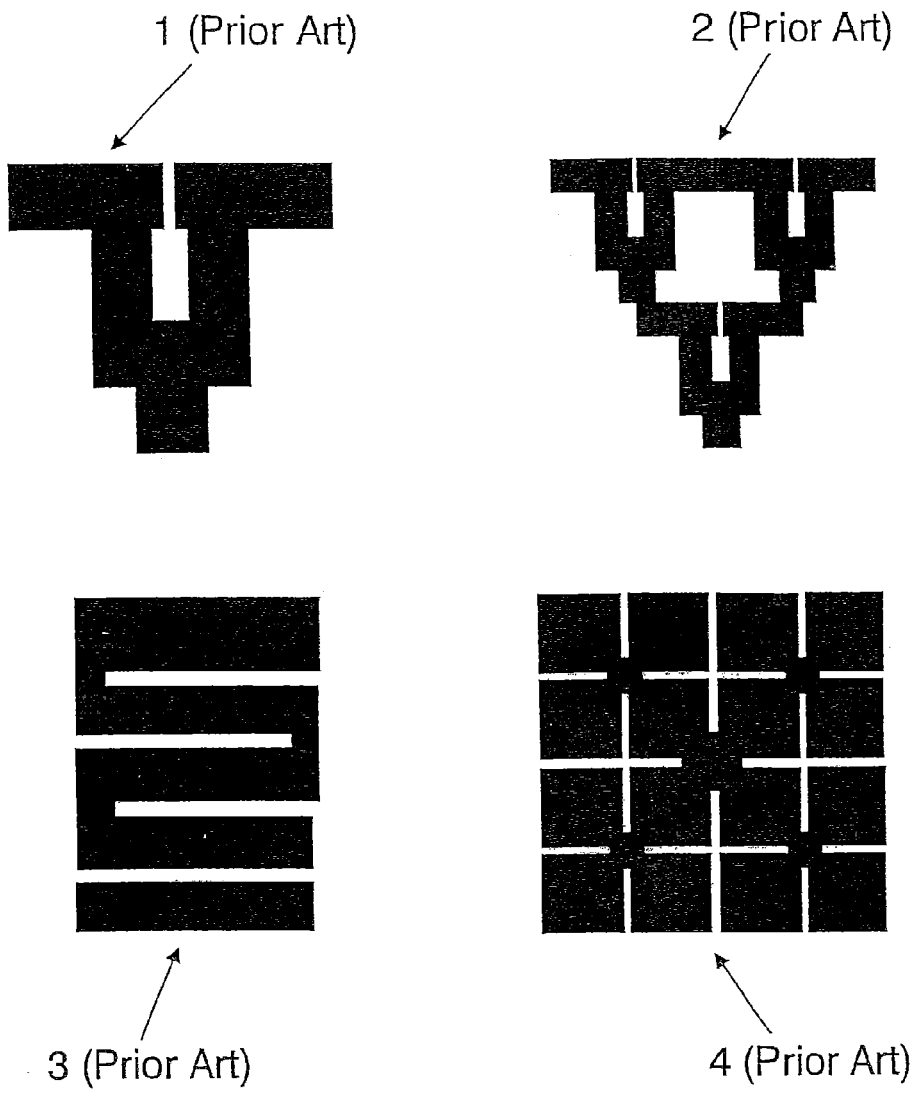
FIG. 1 describes four particular examples (1), (2), (3), (4) of prior-art multilevel geometries for multilevel antennas.
Figure 2:
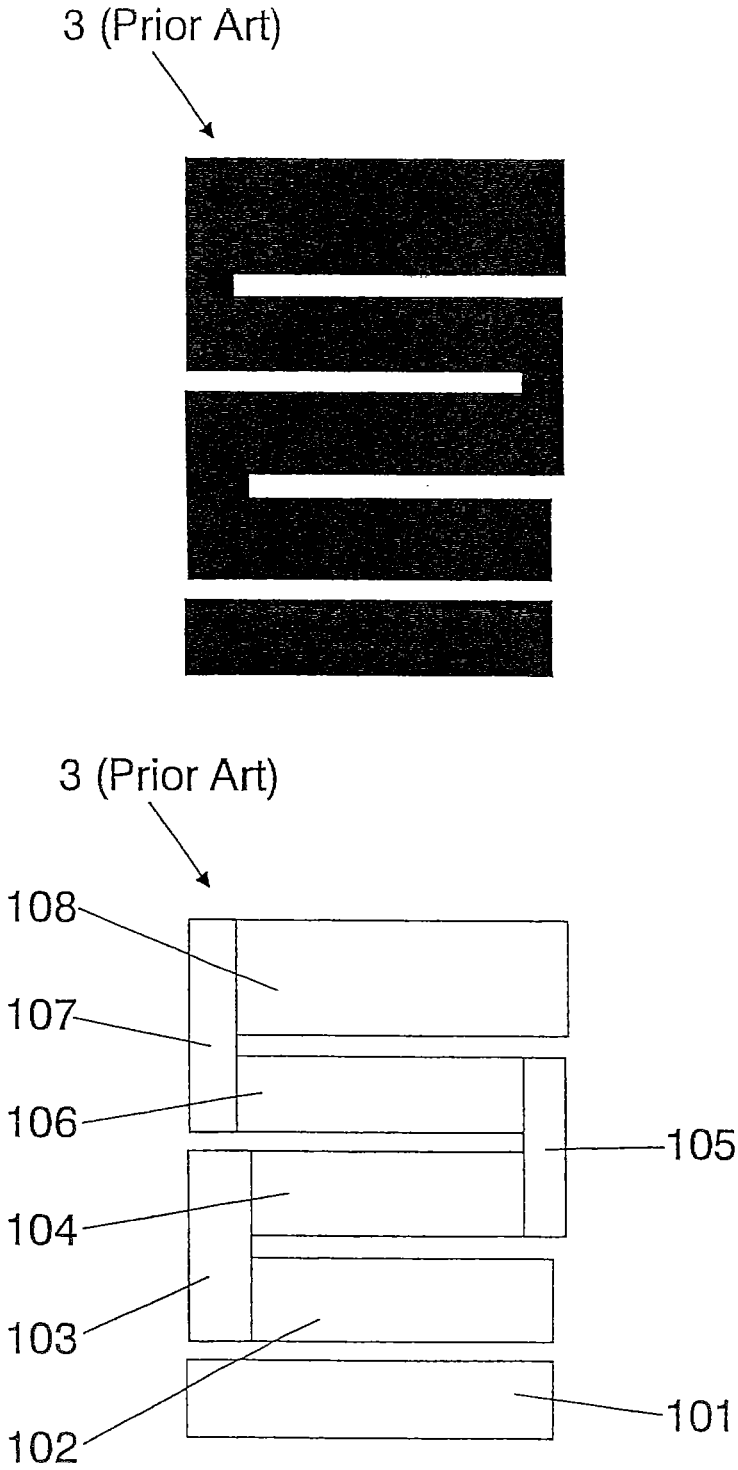
FIG. 2 describes a particular case of a prior-art multilevel antenna formed with eight rectangles (101), (102), (103), (104), (105), (106), (107), and (108).
Figure 3:
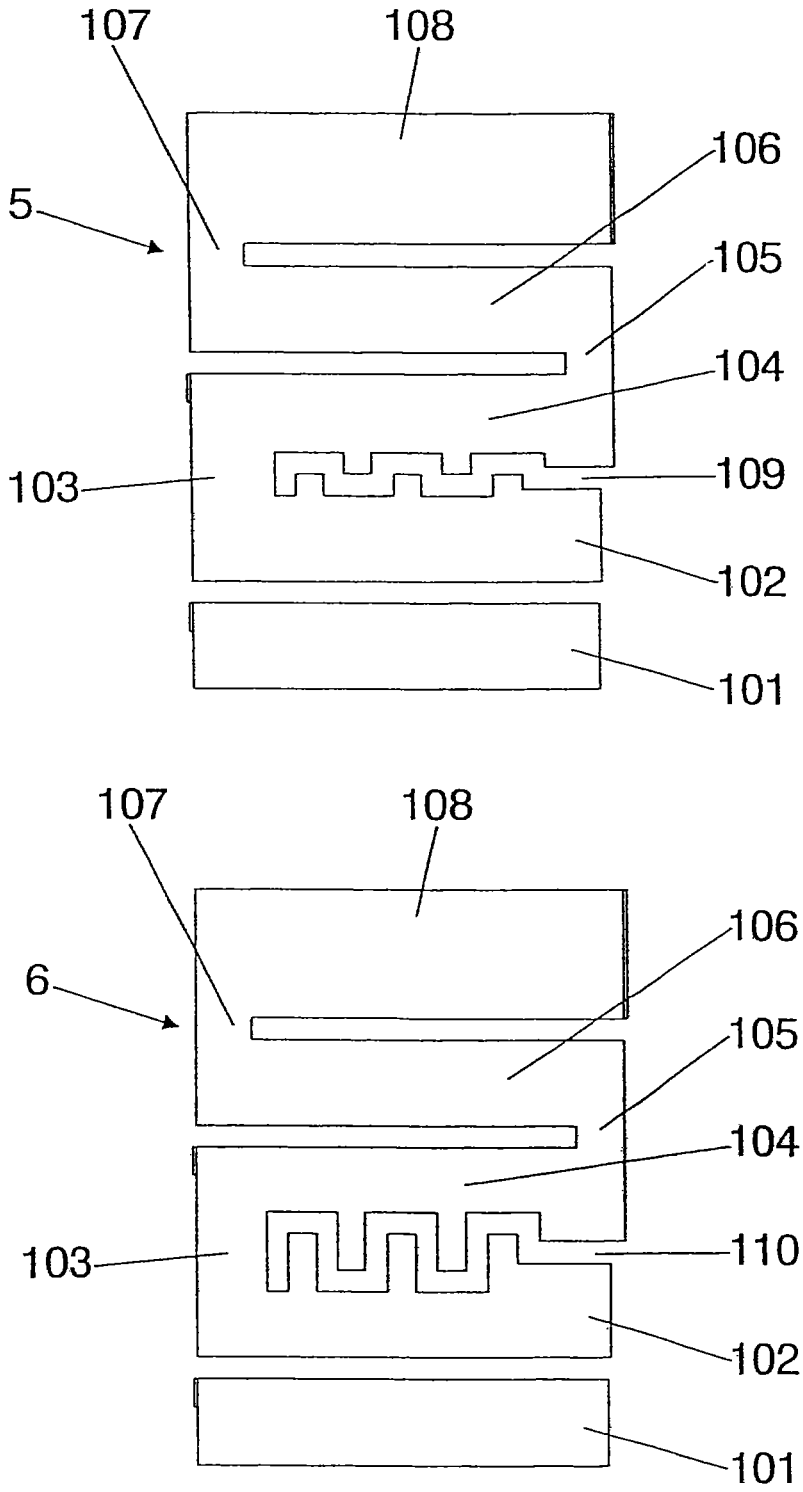
FIG. 3 drawings (5) and (6) show two embodiments of the present invention. Gaps (109) and (110) between rectangles (102) and (104) of design (3) are shaped as non-straight curves (109) according to the present invention.

Drawings (5) and (6) in FIG. 3 show two particular embodiments of the multilevel structure and the non-linear gap according to the present invention. The multilevel structure is based on design (3) in FIG. 2 and it indudes eight conducting rectangles: a first rectangle (101) being capacitively coupled to a second rectangle (102), said second rectangle being connected at one tip to a first tip of a third rectangle (103), said third rectangle being substantially orthogonal to said second rectangle, said third rectangle being connected at a second tip to a first tip of a fourth rectangle (104), said fourth rectangle being substantially orthogonal to said third rectangle and substantially parallel to said second rectangle, said fourth rectangle being connected at a second tip to a first tip of a fifth rectangle (105), said fifth rectangle being substantially orthogonal to said fourth rectangle and substantially parallel to said third rectangle, said fifth rectangle being connected at a second tip to a first tip of a sixth rectangle (106), said sixth rectangle being substantially orthogonal to said fifth rectangle and substantially parallel to said fourth rectangle, said sixth rectangle being connected at a second tip to a first tip of a seventh rectangle (107), said seventh rectangle being substantially orthogonal to said sixth rectangle and parallel to said fifth rectangle, said seventh rectangle being connected to a first tip of an eighth rectangle (108), said eighth rectangle being substantially orthogonal to said seventh rectangle and substantially parallel to said sixth rectangle.

Both designs (5) and (6) include a non-straight gap (109) and (110) respectively, between second (102) and fourth (104) polygons. It is clear that the shape of the gap and its physical length can be changed. This allows a fine tuning of the antenna to the desired frequency bands in case the conducting multilevel structure is supported by a high permittivity substrate.

The advantage of designs (5) and (6) with respect to prior art is that they cover five bands that include the major existing wireless and cellular systems (among AMPS, GSM900, GSM1800, PCS1900, UMTS, Bluetooth™, IEEE802.11b, HiperLAN).

Figure 4:
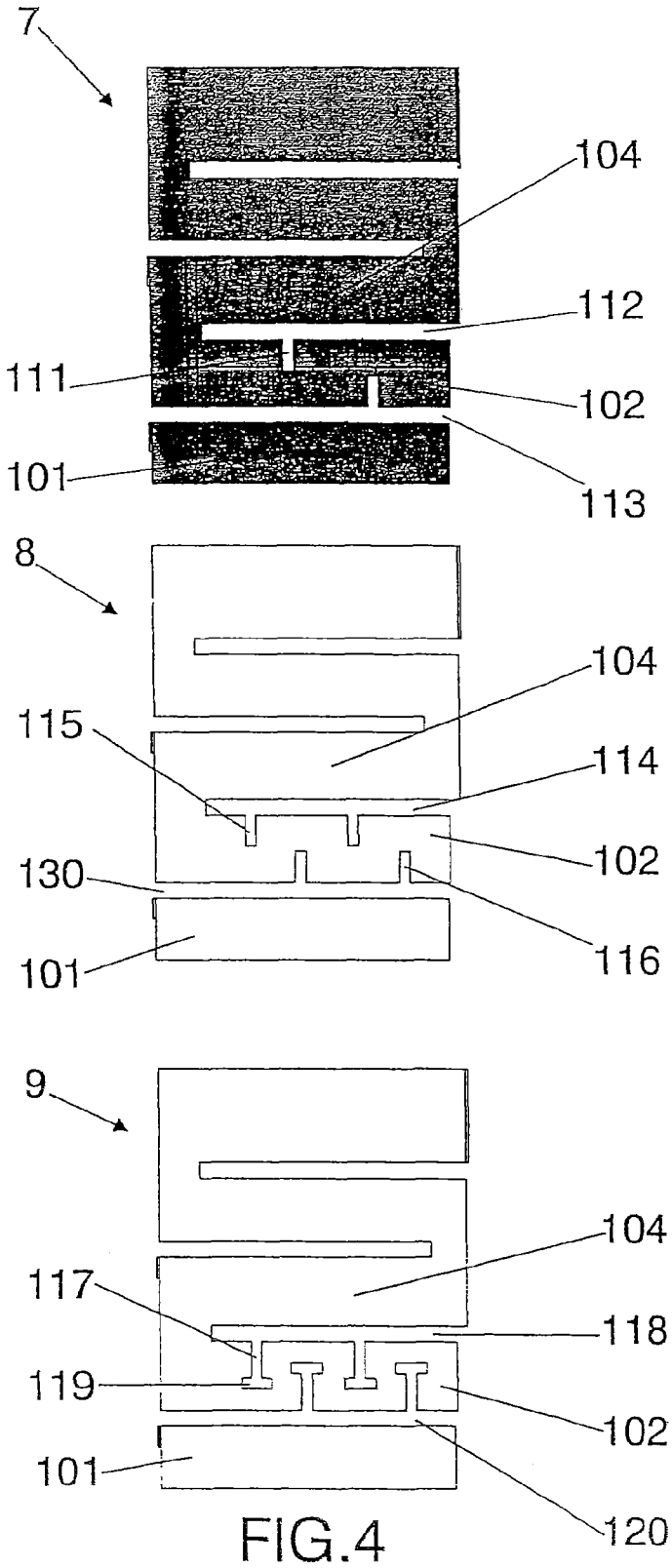
FIG. 4 shows three examples of embodiments (7), (8), (9) for the present invention. All three have in common that include branching gaps (112), (113), (114), (130), (118), (120).

Three other embodiments for the invention are shown in FIG. 4. All three are based on design (3) but they include two shaped gaps. These two gaps are placed between rectangle (101) and rectangle (102), and between rectangle (102) and (104) respectively. In these examples, the gaps take the form of a branching structure. In embodiment (7) gaps (112) and (113) include a main gap segment plus a minor gap-segment (111) connected to a point of said main gap segment. In embodiment (8), gaps (114) and (116) include respectively two minor gap-segments such as (115). Many other branching structures can be chosen for said gaps according to the present invention, and for instance more convoluted shapes for the minor gaps as for instance (117) and (119) included in gaps (118) and (120) in embodiment (9) are possible within the scope and spirit of the present invention.

Figure 5:
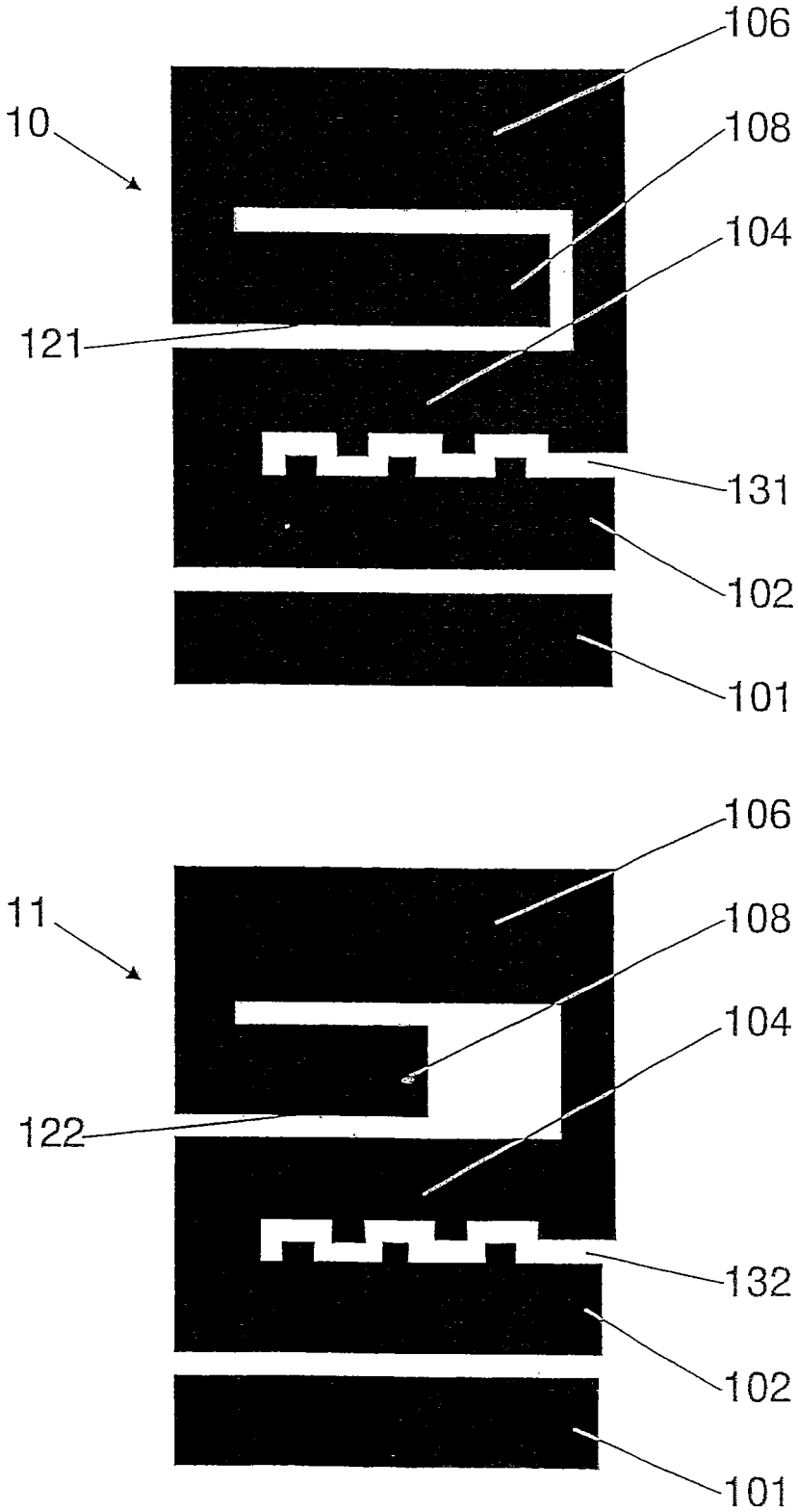
FIG. 5 shows two particular embodiments (10) and (11) for the present invention. The multilevel structure consists of a set of eight rectangles as in, the case of design (3), but rectangle (108) is placed between rectangle (104) and (106). Non-straight, shaped gaps (131) and (132) are placed between polygons (102) and (104).

Although design in FIG. 3 has been taken as an example for embodiments in FIGS. 3 and 4, other eight-rectangle multilevel structures, or even other multilevel structures with a different number of polygons can be used according to the present invention, as long as at least one of the gaps between two polygons is shaped as a non-straight curve. Another example of an eight-rectangle multilevel structure is shown in embodiments (10) and (11) in FIG. 5. In this case, rectangle (108) is placed between rectangles (106) and (104) respectively. This contributes in reducing the overall antenna size with respect to design (3). Length of rectangle (108) can be adjusted to finely tune the frequency response of the antenna (different lengths are shown as an example in designs (10) and (11)) which is useful when adjusting the position of some of the frequency bands for future wireless services, or for instance to compensate the effective dielectric permittivity when the structure is built upon a dielectric surface.

Figure 6:
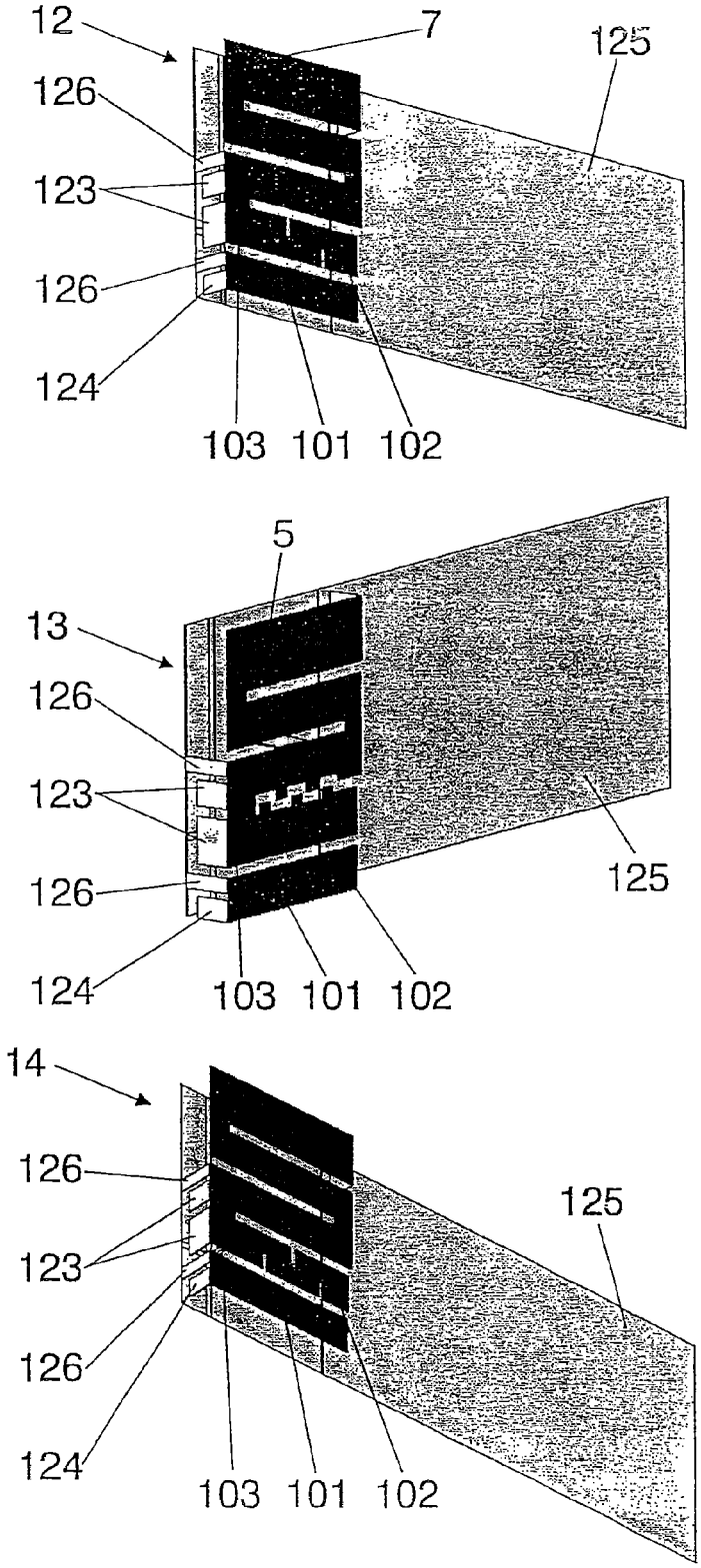
FIG. 6 shows three particular embodiments (12), (13), (14) for three complete antenna devices based on the combined multilevel and gap-shaped structure disclosed in the present invention. All three are mounted in a rectangular ground-plane such that the whole antenna device can be, for instance, integrated in a handheld or cellular phone. All three include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103).

FIG. 6 shows three examples of embodiments (12), (13), and (14) where the multilevel structure is mounted in a particular configuration as a patch antenna. Designs (5) and (7) are chosen as a particular example, but it is obvious that any other multilevel structure can be used in the same manner as well, as for instance in the case of embodiment (14). For the embodiments in FIG. 6, a rectangular ground-plane (125) is included and the antenna is placed at one end of said ground-plane. These embodiments are suitable, for instance, for handheld devices and cellular phones, where additional space is required for batteries and circuitry. The skilled in the art will notice, however, that other ground-plane geometries and positions for the multilevel structure could be chosen, depending on the application (handsets, cellular phones and general handheld devices; portable computers such as Palmtops, PDA, Laptops, indoor antennas for WLAN, cellular indoor coverage, outdoor antennas for microcells in cellular environments, antennas for cars integrated in rear-view mirrors, stop-lights, and bumpers are some examples of possible applications) according to the present invention.

All three embodiments (12), (13), (14) include two-loading capacitors (123) and (124) in rectangle (103), and a loading capacitor (124) in rectangle (101). All of them include two short-circuits (126) on polygons (101) and (103) and are fed by means of a pin or coaxial probe in rectangles (102) or (103). Additionally, a loading capacitor at the end of rectangle (108) can be used for the tuning of the antenna.

It will be clear to those skilled in the art that the present invention can be combined in a novel way to other prior-art antenna configurations. For instance, the new generation of ground-planes disclosed in the PCT application entitled "Multilevel and Space-Filling Ground-planes for Miniature and Multiband Antennas" can be used in combination with the present invention to further enhance the antenna device in terms of size, VSWR, bandwidth, and/or efficiency. A particular case of ground-plane (125) formed with two conducting surfaces (127) and (129), said surfaces being connected by means of a conducting strip (128), is shown as an example in embodiment (15).

Figure 7:
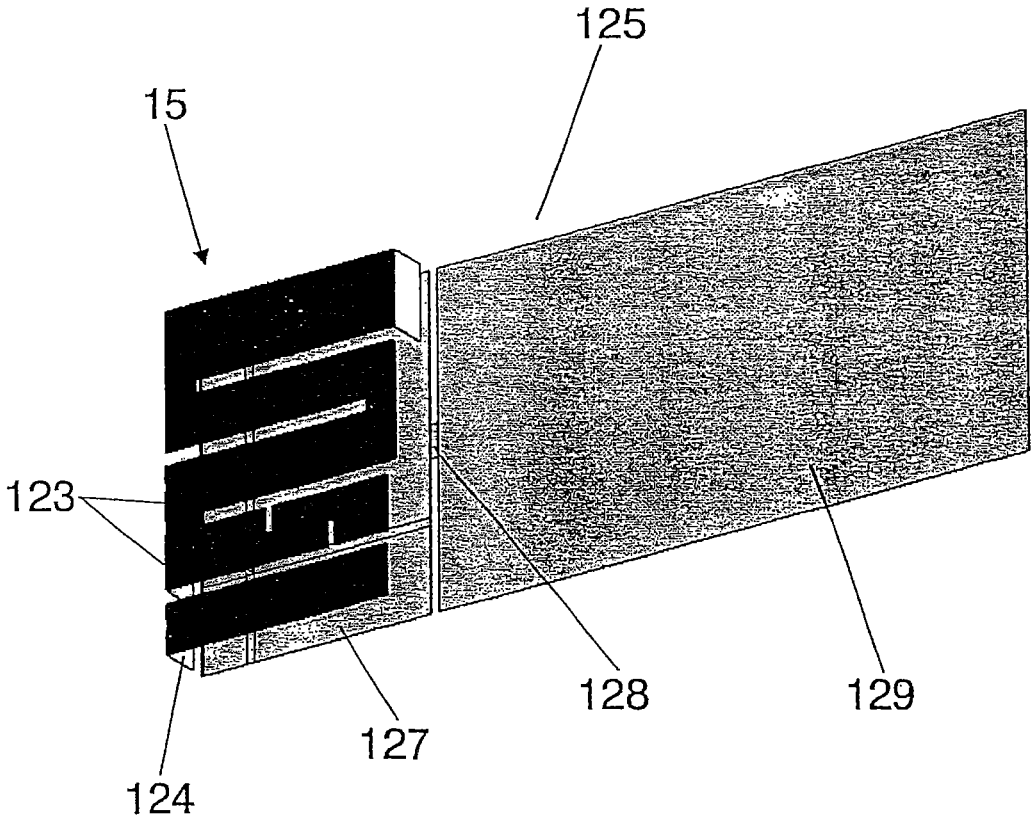
FIG. 7 shows a particular embodiment (15) of the invention combined with a particular case of Multilevel and Space-Filling ground-plane according to the PCT application entitled "Multilevel and Space-Filling Ground-planes for Miniature and Multiband Antennas". In this particular case, ground-plane (125) is formed by two conducting surfaces (127) and (129) with a conducting strip (128) between said two conducting surfaces.

The particular embodiments shown in FIGS. 6 and 7 are similar to PIFA configurations in the sense that they include a shorting-plate or pin for a patch antenna upon a parallel ground-plane. The skilled in the art will notice that the same multilevel structure including the non-straight gap can be used in the radiating elements of other possible configurations, such as for instance, monopoles, dipoles or slotted structures.

It is important to stress that the key aspect of the invention is the geometry disclosed in the present invention. The manufacturing process or material for the antenna device is not a relevant part of the invention and any process or material described in the prior-art can be used within the scope and spirit of the present invention. To name some possible examples, but not limited to them, the antenna could be stamped in a metal foil or laminate; even the whole antenna structure including the multilevel structure, loading elements and ground-plane could be stamped, etched or laser cut in a single metallic surface and folded over the short-circuits to obtain, for instance, the configurations in FIGS. 6 and 7. Also, for instance, the multilevel structure might be printed over a dielectric material (for instance FR4, Rogers®, Arlon® or Cuclad®) using conventional printing circuit techniques, or could even be deposited over a dielectric support using a two-shot injecting process to shape both the dielectric support and the conducting multilevel structure.

What is claimed is:

1. A wireless handheld or portable device comprising:

an antenna mounted within the wireless handheld or portable device and configured to operate in at least two non-overlapping frequency bands, the antenna comprising:

a ground plane;

a feeding mechanism; and a conductive radiating element electrically coupled to the ground plane and connected to the feeding mechanism, the connection between the radiating element and the feeding mechanism defining a feeding point, wherein:

the conductive radiating element extends along a first path, the first path extending from the feeding point through the conducting radiating element to a most distant end of the conductive radiating element;

a spacing between sections of the first path is shaped as a non-straight gap; and a length of a contour of the non-straight gap is greater than a length of a contour of an equivalent straight gap, the equivalent straight gap having a substantially constant width through the spacing that defines the non-straight gap.

2. The wireless handheld or portable device of claim 1, wherein the conductive radiating element is inscribed in a rectangular area having a longest dimension substantially parallel to a shortest side of the ground plane, and wherein the conductive radiating element is placed substantially close to the shortest side.

3. The wireless handheld or portable device of claim 1, wherein the contour of the non-straight gap comprises an arbitrary curve of two to nine segments.

4. The wireless handheld or portable device of claim 1, wherein the contour of the non-straight gap comprises at least ten segments which are connected such that each segment forms an angle with adjacent segments so that no pair of adjacent segments defines a larger straight segment, and wherein, if the contour is periodic along a fixed straight direction of space, the corresponding period is defined by a non-periodic curve composed of at least ten connected segments of which no pair of adjacent ones of the connected segments defines a straight longer segment, and wherein the contour does not intersect with itself at any point or intersects with itself only at an initial and final point of the contour, and wherein the segments of the contour are shorter than a tenth of the free-space operating wavelength of the antenna.

5. The wireless handheld or portable device of claim 1, wherein the non-straight gap comprises a branching curve comprising a main longer curve and at least one added segment or branching curves departing from a point of the main longer curve.

6. The wireless handheld or portable device of claim 1, wherein the non-straight gap modifies the frequency response of the antenna relative to an antenna comprising the equivalent straight gap.

7. The wireless handheld or portable device of claim 1, wherein a current distribution through the first path defines a current path for a frequency band of the at least two non-overlapping frequency bands.

8. The wireless handheld or portable device of claim 1, wherein the non-straight gap contributes to tuning a frequency behavior of the antenna relative to an antenna comprising the equivalent straight gap.

9. The wireless handheld or portable device of claim 8, wherein the conducting radiating element includes a set of polygons, all of the polygons having the same number of sides, wherein said polygons are electromagnetically coupled either by a capacitive coupling or ohmic contact, and wherein a contact region between directly connected polygons is narrower than 50% of the perimeter of said polygons in at least 75% of said polygons defining the conductive radiating structure.

10. The wireless handheld or portable device of claim 9, wherein the antenna operates at least five frequency bands associated to licensed services selected from the group consisting of: Bluetooth, 2.4 GHz Bluetooth, GPS, LTE, GSM 850, GSM 900, GSM 1800, GSM 1900, DCS, PCS, UMTS, CDMA, DMB, DVB-H, WLAN, WCDMA, DAB, WiFi, UWB, 2.4-2.483 GHz band, 2.471-2.497 GHz band, IEEE802.11ba, IEEE802.11b, IEEE802.11g and FM.

11. The wireless handheld or portable device of claim 10, wherein the contour of the non-straight gap comprises an arbitrary curve of two to nine segments.

12. The wireless handheld or portable device of claim 10, wherein the contour of the non-straight gap comprises at least ten segments which are connected such that each segment forms an angle with adjacent segments so that no pair of adjacent segments defines a larger straight segment, and wherein, if the contour is periodic along a fixed straight direction of space, the corresponding period is defined by a non-periodic curve composed of at least ten connected segments of which no pair of adjacent ones of the connected segments defines a straight longer segment, and wherein the contour does not intersect with itself at any point or intersects with itself only at an initial and final point of the contour, and wherein the segments of the contour are shorter than a tenth of the free-space operating wavelength of the antenna.

13. The wireless handheld or portable device of claim 9, wherein the conductive radiating element comprises a second gap.

14. A wireless handheld or portable device comprising:

an antenna mounted within the wireless handheld or portable device and configured to operate in at least a first frequency band and a second frequency band, the first frequency band non-overlapping with the second frequency band, the antenna comprising:

a ground plane; and a conductive radiating element electrically coupled to the ground plane and comprising a first portion defining a first current path for the first frequency band and a second portion defining a second current path for the second frequency band, wherein:

the first portion and the second portion overlap at least partially with each other;

the conductive radiating element comprises a non-straight gap between sections of the second portion;

a length of a contour of the non-straight gap is greater than a length of a contour of an equivalent straight gap, the equivalent straight gap having a substantially constant width between the sections of the second portion defining the non-straight gap.

15. A wireless handheld or portable device comprising:

an antenna mounted within the wireless handheld or portable device and configured to operate in at least four frequency bands, the antenna comprising:

a ground plane;

a feeding mechanism; and a conductive radiating element electrically coupled to the ground plane and connected to the feeding mechanism, the connection between the conductive radiating element and the feeding mechanism defining a feeding point, wherein:

the conductive radiating element extends along a first path and a second path;

the first path extends from the feeding point through the conductive radiating element to a most distant end of the conductive radiating element;

the second path extends from the feeding point through the conductive conducting structure to another end of the radiating element;

a spacing between the first path and the second path defines a non-straight gap; and a length of a contour of the non-straight gap is greater than a length of a contour of an equivalent straight gap, the equivalent straight gap having a substantially constant width through the spacing defining the non-straight gap.

16. The wireless handheld or portable device of claim 15, wherein the contour of the non-straight gap comprises at least ten segments shorter than a tenth of a free-space operating wavelength of the antenna.

17. The wireless handheld or portable device of claim 15, wherein the non-straight gap modifies the frequency response of the antenna relative to an antenna comprising the equivalent straight gap.

18. The wireless handheld or portable device according to claim 17, wherein a current distribution through the first path defines a current path for a frequency band of the at least four frequency bands.

19. The wireless handheld or portable device according to claim 18, wherein the conductive radiating element includes a set of polygons, each of the polygons having the same number of sides, wherein the polygons are electromagnetically coupled either by a capacitive coupling or ohmic contact, and wherein a contact region between directly connected polygons is narrower than 50% of the perimeter of the polygons in at least 75% of the polygons defining the conductive radiating structure.

20. The wireless handheld or portable device of claim 19, wherein the wireless handheld or portable device is selected from the group consisting of a cellular phone, a mobile phone, a handheld phone, a handset, a smart phone, a satellite phone, a multimedia terminal, personal digital assistant (PDA), a personal computer, a Notebook, PC, a pocket PC, a laptop, a portable computer, a palmtop, a laptop, a personal digital assistants, and a tablet.

* * * * *